US005513797A

United States Patent [19]

Lesley

[11] Patent Number: 5,513,797

[45] Date of Patent: May 7, 1996

[54] INSTALLATION OF RAIL TRACKS IN ROADWAYS

[76] Inventor: Lewis Lesley, 30 Moss Lane, Liverpool, L9 8AJ, England

[21] Appl. No.: 208,410

[22] Filed: Mar. 10, 1994

Related U.S. Application Data

[63] Continuation-in-part of Ser. No. 834,307, Feb. 26, 1992, abandoned.

[30] Foreign Application Priority Data

Aug. 26, 1989 [GB] United Kingdom ..... 8919470
Dec. 27, 1989 [GB] United Kingdom ..... 8929213

[51] Int. Cl.[6] ..... E01B 2/00

[52] U.S. Cl. ..... 238/9; 238/2; 238/25; 238/128

[58] Field of Search ..... 238/2, 8, 9, 122, 238/127, 128, 129, 130, 131, 136, 124, 125, 25, 26, 148

[56] References Cited

U.S. PATENT DOCUMENTS 536,305 3/1895 Thomas ..... 238/131
588,080 8/1897 Pennie ..... 238/131 X
1,404,414 1/1922 Wheeler ..... 238/25
4,657,181 4/1987 Bonstrom ..... 238/130

FOREIGN PATENT DOCUMENTS 2278 of 1871 United Kingdom ..... 238/131
3925 of 1872 United Kingdom ..... 238/9
791 of 1873 United Kingdom ..... 238/9
532 of 1874 United Kingdom ..... 238/9
599 of 1875 United Kingdom ..... 238/9

*Primary Examiner*—William E. Terrell
*Assistant Examiner*—Stephen Gordon
*Attorney, Agent, or Firm*—Oblon, Spivak, McClelland, Maier & Neustadt

[57] ABSTRACT

A track rail having a groove for flanges of rail vehicle track wheels in an upper surface of the rail and having a central bar portion and flanges extending integrally sideways from the top of the bar portion is inserted in a recess preformed in the roadway with clearance so the rail is supported from the roadway's surface by the flanges. The rail is shallow so the recess is only shollowly preformed in the roadway. If the roadway has insufficient load-bearing capacity it is possible to reinforce the roadway by a concrete beam around 30 centimeters wide and 10 centimeters deep grouted with concrete in the road surface; this again is shallow for rail tracks. This beam would be recessed to receive the rail as above and also to receive the flanges.

9 Claims, 3 Drawing Sheets

INSTALLATION OF RAIL TRACKS IN ROADWAYS

REFERENCE TO RELATED APPLICATION

This application is a continuation-in-part of application Ser. No. 07/834,307, filed Feb. 26, 1992, abandoned, which was filed as International Application No. PCT/GB90/01325 on Aug. 28, 1990.

FIELD OF THE INVENTION

The present invention concerns a method of installing rail tracks for rail vehicles in a roadway for road vehicles.

BACKGROUND OF THE PRESENT INVENTION

There is an increasing use of light railways in city streets. Conventionally such rails are installed by extensive excavation of the roadway and then installing rails with a downwardly extending I-section resting on sleepers. In practice the roadway would be excavated to a depth of 50 centimeters to provide for a 18 centimeter deep sleeper or bed of concrete. This type of rail is commonly called a Phonenix rail. Such a deep excavation entails re-routing underground services such as water and electricity mains and destroys the integrity of the road construction. Some attempts have been made to reduce the amount of excavation needed. For example in Dresden in the late '50's, a conventional phoenix rail was cast in concrete panels about 20 centimeters deep but this was not practical since it involved short lengths of rail having to be welded together. Dr. Zahummensky in Budapest tried shallow rails inserted in steel-lined channels in 18 centimeters deep concrete panels (the rails being 7 centimeters deep). A snag with such panel systems is that the panels tend to settle or rock although in the Dresden system this was resisted by the rigidity of the rail, which was of phoenix type. A rail similar to that tried in Budapest is shown in German (East) Patent Specification 247 716 for use especially on bridges. A snag with the construction of this Specificaiton is that the rail is supported resiliently from below and thus the loading is not taken from the stronger denser road surface but this surface has to be cut away and the loading taken from a lower weaker substrate surface. Such shallow rails are more flexible and so the rail when subject to wheel loading will give and this will increase the traction force needed. In International Patent Publication WO 84/00391 there is described a phoenix-like rail consisting of an I-beam with a small foot and a large head providing flanges; the flanges provided by the head take some of the loading on the rail. The rail is inserted into a trench to rest on a substrate and then the road is built up around the rail without however the filling material of crushed stone being able to be compacted by road rollers. The flanges rest on a layer of bitumen at best which is forces in to fill the gap left between the flanges and the filling material; bitumen is not a material which is good at taking loading but merely a material which binds stone to give a load-bearing substance. This Specification appears to be a near miss for the present invention as it suggests that it provides the reduced excavation, eliminates the need (or at least reduces the need) for deeply buried sleepers, and takes the wheel loading on the flanges on the surface of the roadway but in practice does not do so.

SUMMARY OF THE PRESENT INVENTION

The present invention in one of its aspects provides a method of installing track rails for rail vehicles in a roadway for road vehicles comprising forming a recess in a roadway to receive a rail, the rail having a surface in a central bar portion for supporting track wheels of a rail vehicle, in which surface there is a groove for receiving flanges of said track wheels, and a pair of flanges extending integrally from the top of the bar portion, and then inserting the rail in the recess, the recess being sized so as to receive the central bar portion with clearance with the flanges suspending the rail from the roadway surface on each side of the recess.

Modern roadways in cities where light railways are more likely to share a roadway with road traffic are built to high standards capable of carrying 40 tonne vehicles with 11 tonne axle loadings. These roadways are expensive and the present invention aims at minimizing the amount of excavation needed by using the highly compacted roadway surface to provide the vertical stiffness of the rail as well as taking the wheel loading. However occasionally the roadways are not of such a high standard and it is necessary to reinforce the roadway. Thus another aspect of the present invention provides a method of installing track rails for rail vehicles in a roadway for road vehicles comprising forming a recess in a roadway to receive a rail, the rail having a surface in a central bar portion for supporting track wheels of a rail vehicle, in which surface there is a groove for receiving flanges of the track wheels, and a pair of flanges extending integrally from the top of the bar portion, wherein the roadway is reinforced by inlaying a concrete beam into the roadway and grouting that beam with a rigid bonding grout with a recess formed in said beam, and the recess receiving the central bar portion with clearance with the flanges suspending the rail from the beam surface on each side of the recess.

It is possible to have the beam recessed to receive not only the bar portion but also the flanges.

The flanges not only serve the function of spreading vertical loading, but also stiffen the rail by contact with the roadway's surface against bending in the vertical direction, grips the roadway to resist cross-loading and minimizes water damage caused by water seeping down the outside of the rail. The flanges can have ridges to bite into the roadway and/or a sealant can be used to provide a water seal and to absorb sideways loading. Where sideways loading is expected to be large, as on bends or intersections it is possible to use phoenix track sections or to tie the two rails together with tie bars or the like.

DESCRIPTION OF EXEMPLARY EMBODIMENTS

Figure 1:
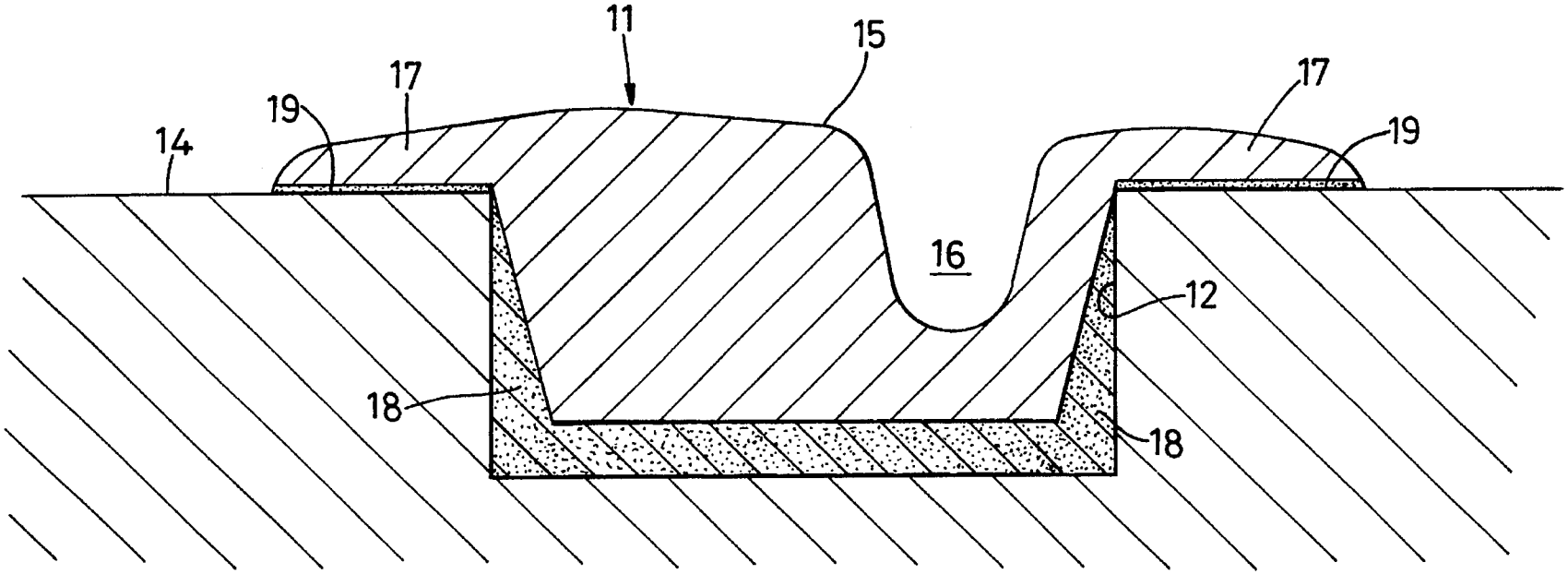
FIG. 1 is a section of a rail fitted in a roadway.

FIG. 1 illustrates, on a large scale, a rail 11 in a shallow recess 12 in a roadway 14. The recess 12 is either preformed by a slip-form paviour or other machine during forming of a concrete roadway, by cutting the recess in an existing roadway be means of disc or other cutters cutting the sides of the recess and such material as remains between those cuts being removed by a plane or other cutter. The rail has a central bar portion 15 with a groove 16 for rail vehicle wheel flanges in an upper surface of the bar portion on which the track wheels are to roll. Extending integrally sideways from the bar portion 15, there is a flange 17 on each side of the rail 11. The recess 12 would be about 10 centimeters wide and 4.25 centimeters deep and the rail 11 would have a central bar portion 15 extending 4 centimeters down from the bottom of the flanges 17 and slightly less than 10 centimeters wide so the recess 12 can receive the bar portion 15 with clearance. That is, the bar portion 15 is approximately 7 centimeters deep with 4 centimeters recessed into the roadway, and up to 0.25 centimeter clearance between a bottom of the rail 11 and a bottom of the recess 12. The bar portion 15 is approximately 10 centimeters wide with the flanges 17 each extending a further 4 centimeters. The bar portion 15 is preferably wider at the top and reduces in width towards the bottom. Thus the bar portion 15 can be easily inserted in the recess 12 and be received therein. The bar portion 15 when located in the recess 12 is bedded and bonded into the roadway 14 by a suitable material 18 with a degree of resiliency such as Corkelast (a proprietary polyurethane with a cork filler) or SIKA KC330 (a proprietary polyurethane with rubber particle filler) some of which as the rail 11 settles will form a sealing and bonding layer 19 between the flanges 17 and the roadway 14.

Figure 2:
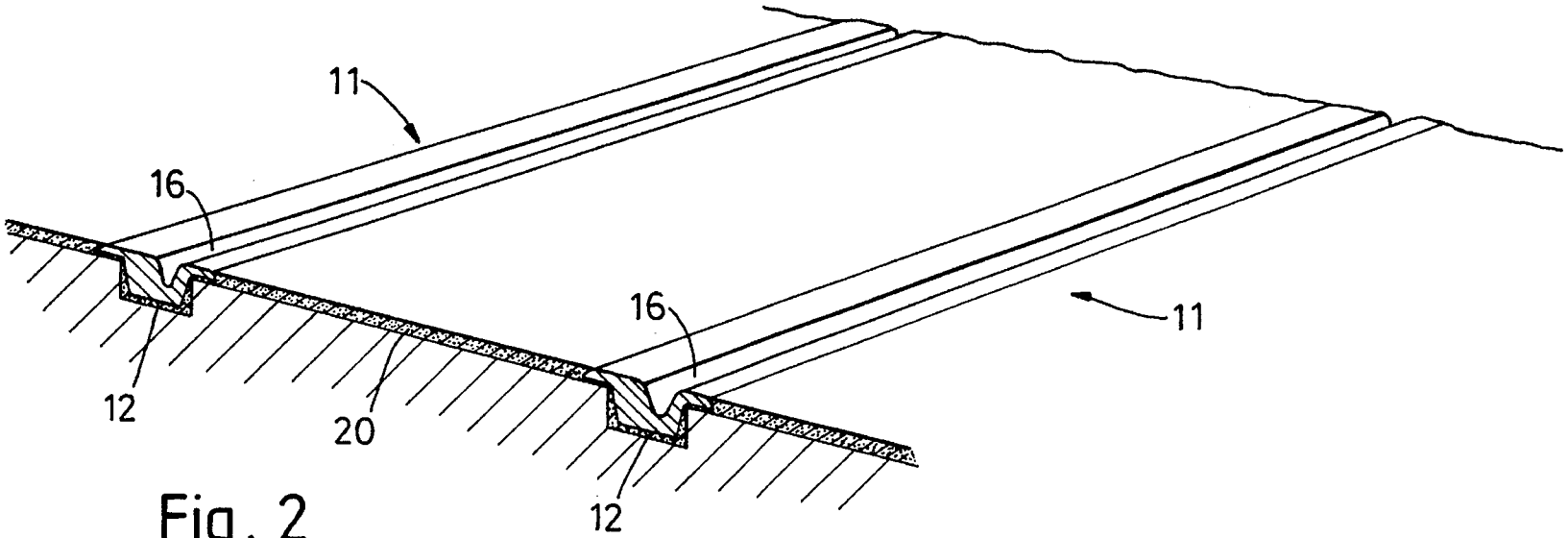
FIG. 2 is a perspective view of a pair of rails fitted in a roadway.

The clearance below the rail 11 should be such that any debris after cutting the recess 12 will remain in the clearance. The rails are of steel, iron, or other material but preferably steel, rolled, extruded or otherwise fabricated into the squat T-shape illustrated; the rail 11 can be secured in place by mechanical means or other means such as an adhesive bond provided by the Corkelast or SIKA KC330. It is possible to provide ribs or a shallow groove in the underside of each flange 17 to provide or improve the sealing and the resistance to sideways motion of the rail. Rails can be welded from lengths of rails end-to-end to form a continuous track and can be laid under tension to avoid thermal expansion problems. As shown in FIG. 2, a pair of rails 11 will normally be used and a pair of recesses 12 can be cut simultaneously using ganged cutters to ensure correct spacing. Cross-ties (not illustrated) can be provided at intervals to form gauge defining devices and these ties can be recessed shallowly below the roadway surface.

To avoid crossing road traffic and in particular two-wheeled vehicles such as pedal or motor cycles being inconvenienced by the smooth metallic bumps formed by the tops of the rails, it is possible to build up the surface of the roadway between the rails 11 and outside the rails by a layer of tarmac or other road facing material to the level of the tops of the rails.

Figure 3:
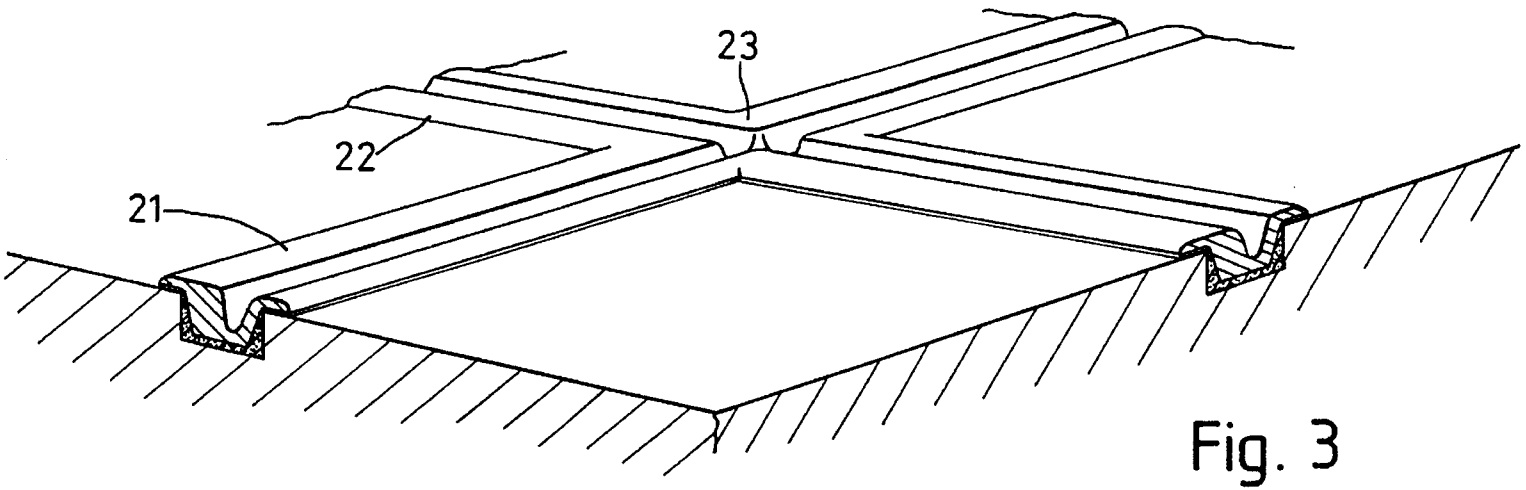
FIG. 3 is a perspective view showing a rail intersection.

FIG. 3 illustrates a junction piece which would be cast or otherwise formed and comprises two rails 21 and 22 crossing at an angle with the grooves in the two rails extending across the central intersection 23. Where more complicated arrangements are involved with high cross-loading is involved, it may be necessary to have sections of phoenix track but this would be localized and should not unduly inflate the cost of the entire track.

While the present invention is mainly intended for railroad surfaces, the low profile rail according to the present invention offers advantages due to the reduction in rail height over traditional rail track especially when a track is being adapted for guage conversion or electrification since it may not be necessary to lower an existing track foundation with the possible exposure of wall foundations in existing tunnels.

Figure 4:
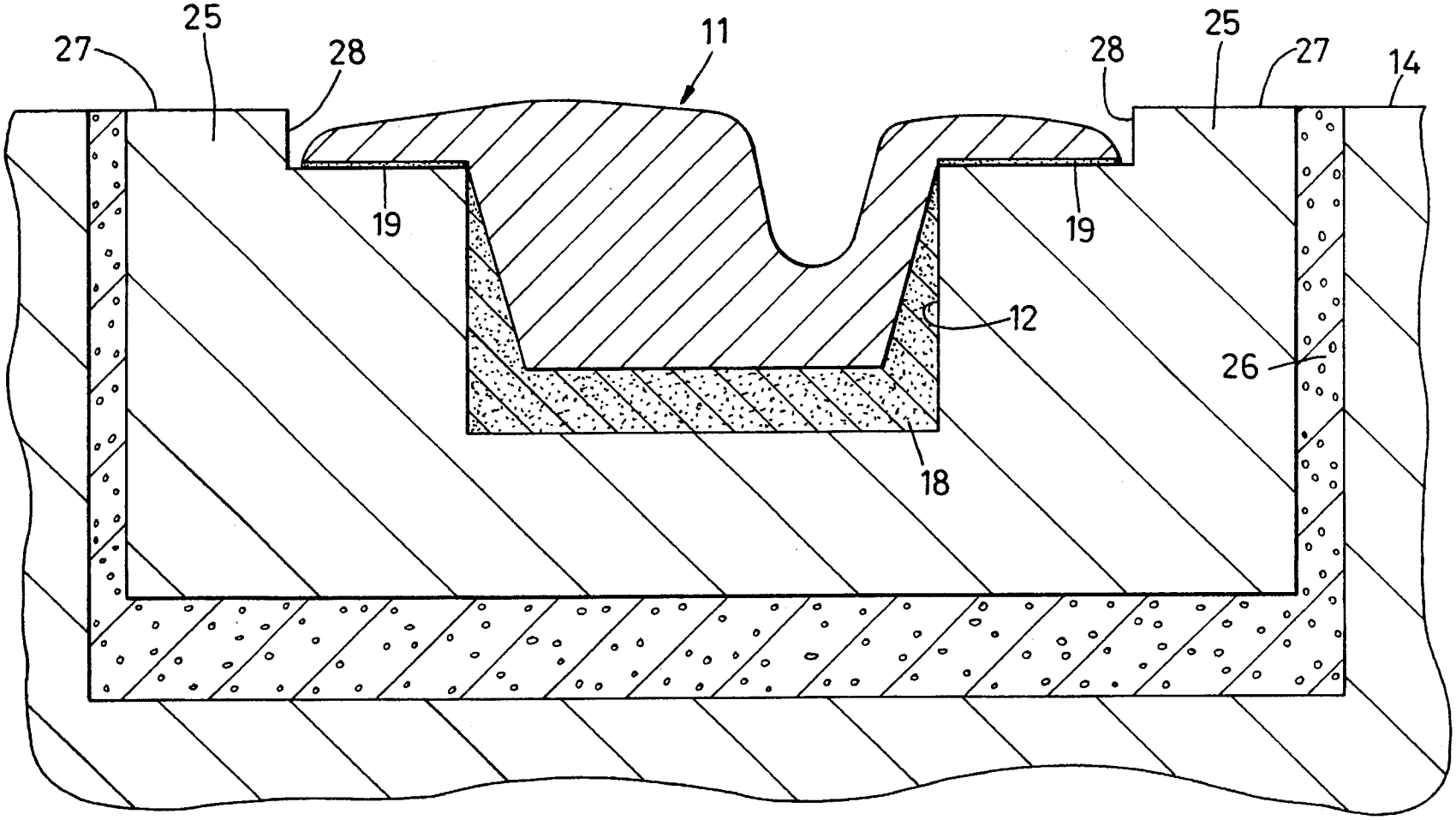
FIG. 4 is a section showing how a roadway can be reinforced to take track loading.

The present invention is mainly intended for use with high quality roadways but it is possible to reinforce a relatively low-load-taking surface. A concrete slab 25 (FIG. 4) of the order of 30 centimeters wide and 10 centimeters deep is recessed, and grouted with a rigid material 26 such as concrete, into the roadway with its upper surface 27 flush with the roadway 14. This slab 25 is provided with a recess 12 extending below a recess 28 for the flanges of a rail 11. The flanges would normally extend about 4 centimeters from the bar portion so the vertical loading on a rail is not merely taken on two 4 centimeters wide flanges onto the roadway but is taken onto two 4 centimeter wide flanges onto the concrete slab 25 with some of the loading then being taken by the grout to the sides of the recess for the slab 25 but most being taken on the base of the slab which is a strip 30 centimeters wide and so has an area 3¾ times the area of two flanges. Irregularities in the upper surfaces of the recesses 28 can be moderated by the use between the rail and the slabs of a grouting material 18; the slabs will have to be laid in lengths of around 5 meters length.

The rails can be used for electrical communication or power supply if the rails are insulated but it is probably impractical to supply sufficient power to drive a vehicle in this way but only to use the rails as a return path, but even then it would be desirable to bond the rails to a low impedance earth-cable at intervals to avoid earth leakage currents interfering with other services. The cross-section of the rails depends on the use. The groove can be shaped so it merely engages track wheel flanges or in addition it can engage sensing wheels transmitting steering information to the track wheels.

I claim:

1. A method of installing rail tracks for rail vehicles, in a roadway for road vehicles, the method comprising the steps of:

forming an elongate rail with a transverse cross-section comprising a central bar portion and a pair of oppositely directed laterally extending flanges which extend integrally from a top region of the bar portion, the central bar portion having an upper surface which is formed with a groove for receiving flanges of rail vehicle wheels when the wheels are supported on said upper surface;

forming a recess in the roadway to receive the central bar portion of the rail with a clearance so that the laterally extending flanges rest on a surface of the roadway to each side of the recess and thereby support the rail; and laying the central bar portion of the rail in the recess with the laterally extending flanges resting on the roadway surface to each side of the recess.

2. A method according to claim 1, comprising the further step of using an adhesively bonding material with a degree of resiliency to seal between the rail and the recess.

3. A method according to claim 1, comprising the further step of forming a second elongate rail with a recess in said roadway at the same time as the first mentioned elongate rail so that the rails and recesses are accurately located relative to each other.

4. A method according to claim 1, comprising the further step of welding the rail from lengths of rail track which have been pretensioned.

5. A method according to claim 1, wherein the bar portion is approximately 7 centimeters deep with 4 centimeters recessed into the roadway and said clearance is up to a 0.25 centimeter clearance between a bottom of the rail and a bottom of the recess, the bar portion being approximately 10 centimeters wide with the flanges each extending a further 4 centimeters.

6. A method according to claim 1, including the further steps of forming a further rail intersection, and forming grooves in the intersecting rails, the intersecting rails crossing at an angle with said grooves in the rails extending across the intersection.

7. A method of installing rail tracks for rail vehicles, in a roadway for road vehicles, the method comprising the steps of:

forming an elongate rail with a transverse cross-section comprising a central bar portion and a pair of oppositely directed laterally extending flanges which extend integrally from a top region of the central bar portion, the central bar portion having an upper surface which is formed with a groove for receiving flanges of rail vehicle wheels when the wheels are supported on said upper surface;

forming a concrete beam with a recess in which the central bar portion can be located with a clearance; laying the beam in the roadway;

grouting the beam in the roadway with a rigid grout; and laying the central bar portion of the rail in said recess with the laterally extending flanges resting on the beam to either side of the recess, the rail being thus supported by said laterally projecting flanges.

8. A method according to claim 7, wherein the beam is wider than the rail inclusive of said flanges.

9. A method according to claim 7, including the further step of forming the concrete beam with recessed regions to each side of said recess, said flanges being supported on said recessed regions.

* * * * *